United States Patent [19]

Voland

[11] Patent Number: 4,490,589

[45] Date of Patent: Dec. 25, 1984

[54] TIMING MECHANISM

[75] Inventor: Elmo W. Voland, Indianapolis, Ind.

[73] Assignee: Emhart Industries, Inc., Indianapolis, Ind.

[21] Appl. No.: 437,166

[22] Filed: Oct. 27, 1982

[51] Int. Cl.[3] ..... H01H 43/10

[52] U.S. Cl. ..... 200/38 R; 200/38 BA; 368/109

[58] Field of Search ..... 200/35 R, 38 R, 38 F, 200/38 A, 38 FA, 38 B, 38 BA, 38 C, 38 CA, 39 R, 153 V; 368/254, 257, 258

[56] References Cited

U.S. PATENT DOCUMENTS

| | | | |
|---|---|---|---|
| 3,500,005 | 3/1970 | Brown | 200/38 B |
| 3,581,028 | 5/1971 | Valbona | 200/153 V X |
| 3,737,597 | 6/1973 | Jones et al. | 200/38 BA |
| 4,103,119 | 7/1978 | Homan et al. | 200/38 B X |
| 4,242,746 | 12/1980 | Schuder | 368/254 X |

*Primary Examiner*—J. R. Scott
*Attorney, Agent, or Firm*—Robert F. Meyer

[57] ABSTRACT

The invention is a timing mechanism comprising a motor drive having an output member including at least one leg, a shaft including a circular hub portion having a circular recess therein, a spring tightly and frictionally held within and against an inner wall of the recess, at least one tang extending from the spring and engaging the leg, cams independently rotatably carried on the hub portion through a bore in the cams, a lost motion connection coupling the cams to the hub portion, and a switch assembly responsive to a rotation of the cams to be opened and closed dependent upon the mode of operation. A spring clutch permits the shaft to be manually rotated independent of the motor drive. At the end of a time cycle, a movable switch blade of the switch assembly move a slider to actuate a bell.

12 Claims, 3 Drawing Figures

TIMING MECHANISM

BACKGROUND OF THE INVENTION

Generally speaking, the present invention pertains to a timing mechanism which comprises a motor drive means having an output member including at least one leg, a shaft including a circular hub portion having a circular recess therein, a spring tightly and frictionally held within and against an inner wall of the recess, and a least one tang extending from the spring and engaging the leg, cam means independently rotatably carried on the hub portion through a bore in the cam means, coupling means coupling the cam means to the hub portion, and switch means responsive to a rotation of the cam means to be opened and closed thereby.

The present invention pertains to a timing mechanism and more particularly to such a timing mechanism having, among other things, a clutch to allow manual rotation of its cams and a means to actuate a bell at the end of a timing cycle. The invention is particularly useful in timing mechanisms which are used in appliances such as microwave ovens, dryers and dishwashers.

FEATURES OR OBJECTS OF THE INVENTION

A feature of the present invention is to provide a timing mechanism having a clutch which operates from a spring. Another feature of the invention is to provide such a timing mechanism wherein the spring is frictionally held within a hub portion of a shaft and wherein the distal ends of the spring engage an output member of a motor drive means. Still another feature of the invention is to provide such a timing mechanism wherein a lost motion connection connects a cam means to the hub portion of the shaft. Another feature of the invention is to provide such a timing mechanism wherein the sounding of a bell is responsive to a movement of a switch means that is responsive to the cam means. These and other features of the invention will become apparent from the following description taken in conjunction with the accompanying drawings.

DETAILED DESCRIPTION OF THE INVENTION

Figure 1:
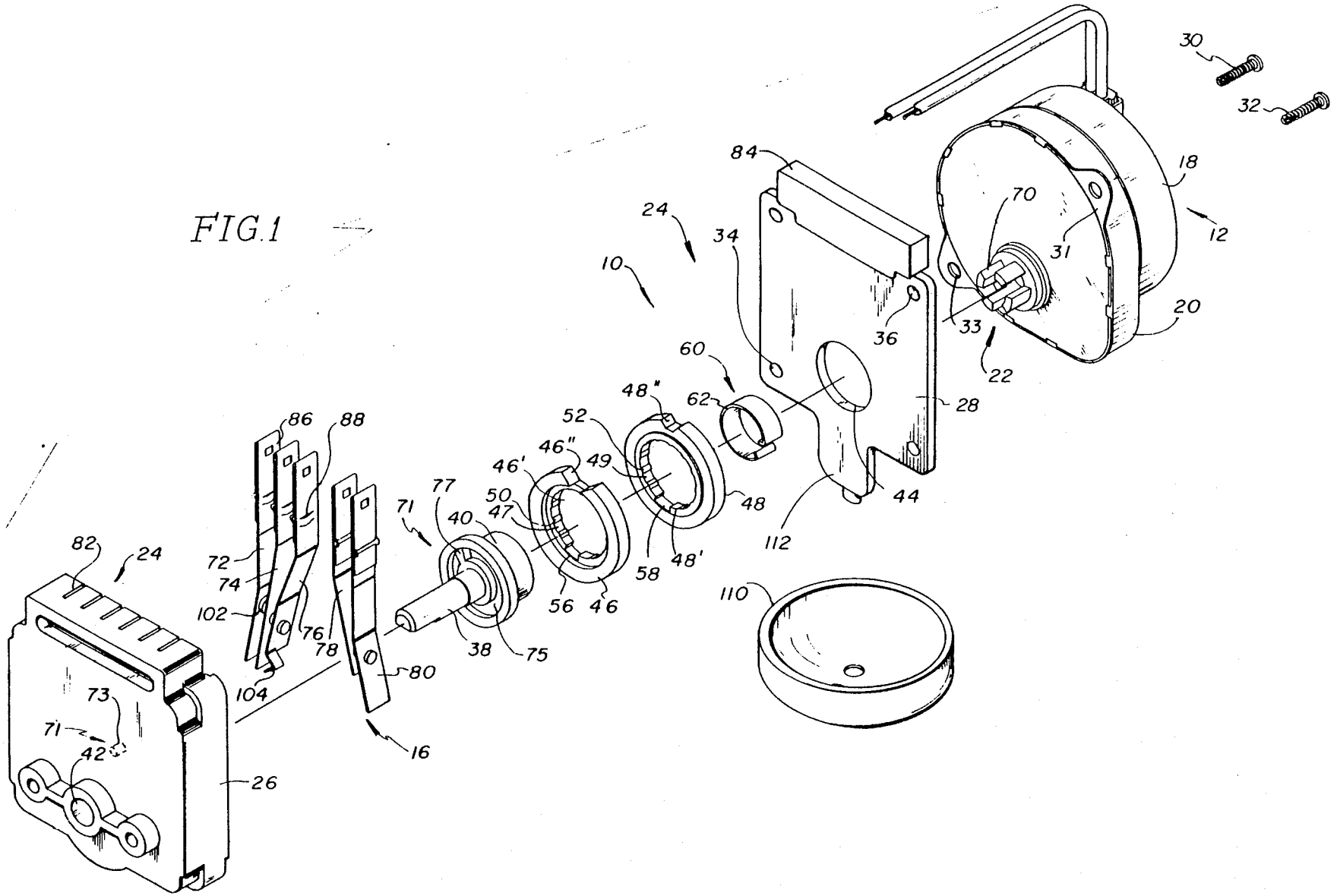
FIG. 1 is an exploded view of a timing mechanism showing the features of the invention.

Referring now to the drawings, there is shown a timing mechanism 10 which in general includes a motor drive means 12, cam means 14, and switch means 16 which are responsive to a rotation of the cam means. Motor drive means 12 includes a synchronous motor 18 and a gear train carried within housing 20 and having an output member 22. Cam means 14 and switch means 16 are carried within a housing 24 which includes a cup-shaped member 26 having an open end which is closed by a cover 28. Motor drive means 12 is carried on the outside of cover 28 through screws 30 and 32 which extend through ears 31 and 33, and apertures 34 and 36 and engage threaded bores in cup-shaped member 26.

A shaft 38 includes a hub portion 40 and extends through aperture 42 in cup-shaped member 26 and aperture 44 in cover plate 28. Cam means 14 includes a pair of cam rings 46 and 48 which are carried on hub 40 through their respective bores 46' and 48'. Each of the bores includes a plurality of ridges 50 and 52 carried on their inner surfaces 47 and 49 and extending lengthwise therein which tend to reduce the rotational friction between the cams and hub 40. Each of the cam rings are coupled to the hub portion 40 for rotation therewith through a tang 54 (FIG. 2) extending from the hub portion and engaging notches 56 and 58 of the cams. The notches are each somewhat larger than the tang so as to provide a lost motion connection. Such lost motion connection provides for snap action switching.

Figure 2:
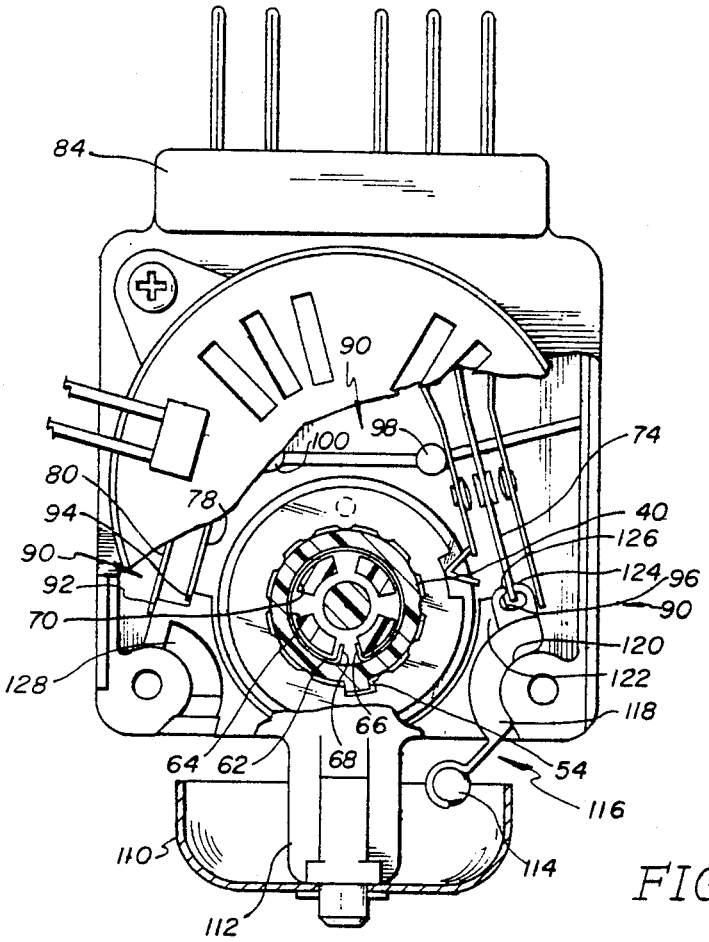
FIG. 2 is an elevation of the timing mechanism in partial cross section.

A clutch 60 permits rotation of the cams independent of motor drive means 12. Clutch 60 includes a spring 62 which is frictionally carried against an inner wall of recess 64 of hub portion 40 (FIG. 2). As best shown in FIG. 2, tangs 66 and 68, which extend from distal ends of the spring, straddle one of the legs 70 of output member 22 of motor drive means 12. Returning to FIG. 1, the amount of manual rotation may be limited in accordance with a customer's program by a stop means 71. Stop means 71 includes a post 73 which rides in arcuate slot 75 of the hub portion 40 and which engages a ledge 77 provided in the slot 75 at a desired program setting.

Switch means 16 includes a plurality of movable blades 72, 74, 76, 78 and 80 which are carried in slots 82 of cup-shaped member 26 and are held in place by terminal block 84 which is carried by cover plate 28. As shown, each of the spring blades is integrally constructed with electrical terminals 86. The blades, with their terminals, are rigidly held within each of the slots 82 through projections 88 that are lanced from the blade and terminals and carried in notches formed in slots 82 (not shown) adapted to mate the projections.

Figure 3:
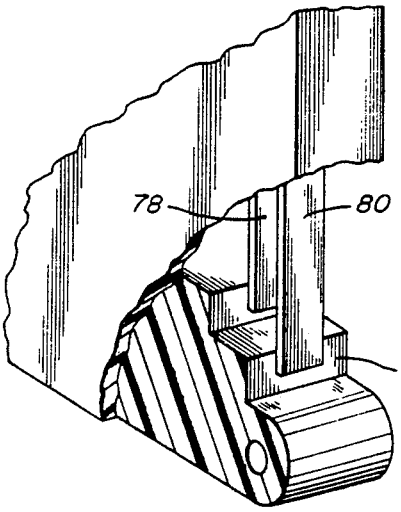
FIG. 3 is a perspective view showing a pair of blades of the switch means of the timing mechanism.

Each of the spring blades includes mating electrical contacts 102 and blades 76 and 78 include cam follower 104 which engages cams 46 and 48 to be opened and closed through notches 46" and 48" of the cams. Movement of the blades is limited by stop means 90. Stop means 90 (FIGS. 2 and 3) includes steps 92, 94 and 96 and posts 98 and 100. Such stop means hold the blades at a predetermined spacing. In the present embodiment, blades 78 and 80 are "dummy" blades and, therefore, not in use and consequently blade 78 does not have a cam follower.

The timing mechanism also includes an alarm device for signaling the end of a cycle. The alarm device includes a bell 110 that is carried on a stem 112 of cover plate 28. The bell 110 includes a striker 114. Striker 114 is actuated by an actuating means 116 which includes a slider 118 carried in arcuate slot 120 and having a distal end 122 which includes a pair of fingers 124 and 126 which engages movable blade 74 of switch means 16. Movement of blade 74 causes the slider 118 to move within the arcuate slot 120 and actuate the striker 114 to sound the bell 110. A corresponding arcuate slot 128 is provided on the opposite side of the housing so that the position of the bell may be changed.

In operation, cam rings 46 and 48 are manually rotated through shaft 38 indpendent of motor drive means 12 through spring clutch 60 to provide a desired program. Power driven rotation is applied from motor drive means 12 through legs 70 of output member 22 which engage spring 62 to rotate hub 40 through its frictional engagement with the hub. Rotation of hub 40 causes rotation of cam rings 46 and 48 through lost motion connection provided between tang 54 of the hub and notches 56 and 58. When spring blade 74 is moved (usually at the end of a cycle) to open its mating contacts to shut off the motor drive means, slider 118 is moved to actuate bell 110 through striker 114.

What is claimed is:

1. A timing mechanism comprising:

(a) a motor drive means having an output member including at least one leg, (b) a shaft including a circular hub portion having a circular recess therein, (c) a spring tightly and frictionally held within and against an inner wall of said recess, and at least one tang extending from said spring and engaging said leg.

(d) cam means independently rotatably carried on said hub portion through a bore in said cam means, (e) coupling means coupling said cam means to said hub portion, and (f) switch means responsive to a rotation of said cam means to be opened and closed thereby.

2. A timing mechanism according to claim 1 wherein said coupling means includes a lost motion connection.

3. A timing mechanism according to claim 2 wherein said lost motion connection includes a tab extending from said hub portion and a notch in said bore receiving said tab, said notch being slightly larger than the size of said tab.

4. A timing mechanism according to claim 1 wherein there are two of said tangs, one each extending from distal ends of said spring and straddling said leg to provide rotational direction of said spring in either direction.

5. A timing mechanism according to claim 1 wherein said cam means includes two independently operable rings and said coupling means includes two lost motion connections one of said lost motion connections located between each said ring and said hub portion.

6. A timing mechanism according to claim 5 wherein each of said rings includes a bore and a plurality of ridges extending lengthwise in said bore.

7. A timing mechanism according to claim 1 wherein said switch means includes movable electrical contact blades including a cam follower fixedly carried at one end by a housing for said timing mechanism, a distal end of at least one of said blades engaging said cam means.

8. A timing mechanism according to claim 1 wherein a stop means includes a post carried by a housing of said timing mechanism engaging an arcuate slot in said hub portion and a ledge carried in said arcuate slot.

9. A timing mechanism according to claim 1 further including an alarm device and actuator means connected to said switch means and to an activator means of said alarm device to activate said alarm device upon movement of said switch means.

10. A timing mechanism according to claim 9 wherein said actuator includes a slider integral with said activator means and carried in a slot provided in a housing of said timing mechanism, and fingers in an end of said slider engaging said switch means.

11. A timing mechanism according to claim 1 wherein said bore of said cam means includes a plurality of ridges engaging said cam means to reduce friction between said cam means and said hub.

12. A timing mechanism comprising:

(a) a motor drive means having an output member, (b) a shaft including a circular hub portion having a circular recess therein, (c) a clutch means coupling said hub portion to said output member to permit manual rotation of said hub portion independent of said output member, (d) cam means independently rotatably carried on said hub portion through a bore in said cam means, (e) ridges extending lengthwise on an inner surface of said bore to reduce friction between said cam means and said hub, (f) coupling means coupling said cam means to said hub portion, and (g) switch means responsive to a rotation of said cam means to be opened and closed thereby.

* * * * *